US007681539B2

(12) United States Patent
Wineland et al.

(10) Patent No.: US 7,681,539 B2
(45) **Date of Patent: *Mar. 23, 2010**

(54) METHOD FOR IMPROVING OPERATION OF AN ELECTRICALLY OPERABLE MECHANICAL VALVE

(75) Inventors: Richard Wineland, Chelsea, MI (US); Craig Stephan, Ann Arbor, MI (US); Jim McCarthy, Pinckney, MI (US); Clay Maranville, Ypsilanti, MI (US); Larry Elie, Ypsilanti, MI (US); Allan Gale, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 520 days.

This patent is subject to a terminal disclaimer.

(21) Appl. No.: 11/566,890

(22) Filed: Dec. 5, 2006

(65) Prior Publication Data

US 2008/0127918 A1 Jun. 5, 2008

(51) Int. Cl.
*F01L 9/04* (2006.01)

(52) U.S. Cl. ..... 123/90.11; 251/129.01; 251/129.16; 123/445

(58) Field of Classification Search ..... 123/90.11, 123/445, 458, 464, 478; 251/129.01, 129.15, 251/129.16, 129.18, 129.02, 129.19, 129.2, 251/129.21, 129.22; 239/133, 135
See application file for complete search history.

(56) References Cited

U.S. PATENT DOCUMENTS

| | | | | |
|---|---|---|---|---|
| 2,789,550 | A * | 4/1957 | Black | 123/90.65 |
| 3,601,110 | A | 8/1971 | Kamazuka | |
| 3,999,525 | A | 12/1976 | Stumpp et al. | |
| 4,137,872 | A | 2/1979 | Loflin | |
| 4,886,032 | A | 12/1989 | Asmus | |
| 4,934,907 | A | 6/1990 | Kröner | |
| 5,121,730 | A | 6/1992 | Ausman et al. | |
| 5,159,915 | A | 11/1992 | Saito et al. | |
| 5,201,341 | A | 4/1993 | Saito et al. | |
| 5,479,901 | A | 1/1996 | Gibson et al. | |
| 5,494,219 | A | 2/1996 | Maley et al. | |
| 5,752,308 | A | 5/1998 | Maley et al. | |
| 5,915,626 | A | 6/1999 | Awarzamani et al. | |
| 5,954,030 | A | 9/1999 | Sturman et al. | |
| 6,076,508 | A | 6/2000 | Nakano | |
| 6,192,868 | B1 | 2/2001 | Barnes et al. | |
| 6,257,499 | B1 | 7/2001 | Sturman | |

(Continued)

FOREIGN PATENT DOCUMENTS

JP 11210873 A * 8/1999

OTHER PUBLICATIONS

U.S. Appl. No. 11/566,911.

(Continued)

*Primary Examiner*—Ching Chang
(74) *Attorney, Agent, or Firm*—Allan J. Lippa; Alleman Hall McCoy Russell & Tuttle LLP

(57) ABSTRACT

A method to improve the performance of an electrically operable mechanical valve actuator is described. The system is capable of providing heat to targeted areas of an actuator so that valve performance may be improved during at least some operating conditions.

20 Claims, 9 Drawing Sheets

U.S. PATENT DOCUMENTS

| | | | | |
|---|---|---|---|---|
| 6,392,865 | B1 | 5/2002 | Fochtman et al. | |
| 6,561,168 | B2 | 5/2003 | Hokao et al. | |
| 6,575,138 | B2 | 6/2003 | Welch et al. | |
| 6,799,559 | B2 | 10/2004 | Mieny et al. | |
| 6,820,856 | B2 | 11/2004 | Grill | |
| 7,516,733 | B2 * | 4/2009 | Stephan et al. | 123/445 |
| 2004/0011900 | A1 | 1/2004 | Gebhardt et al. | |
| 2004/0112316 | A1 | 6/2004 | Oleksiewicz | |
| 2005/0263136 | A1 | 12/2005 | Rigney | |
| 2006/0064967 | A1 | 3/2006 | Frank et al. | |

OTHER PUBLICATIONS

U.S. Appl. No. 11/566,932.
U.S. Appl. No. 11/566,966.
U.S. Appl. No. 11/566,981.
U.S. PTO Office Action, Mailed Feb. 6, 2008, U.S. Appl. No. 11/566,911.
U.S. PTO Office Action, Mailed: Sep. 13, 2007, U.S. Appl. No. 11/566,911.
Applicants' Admission of Prior Art.

* cited by examiner

METHOD FOR IMPROVING OPERATION OF AN ELECTRICALLY OPERABLE MECHANICAL VALVE

FIELD

The present description relates to a method for improving the performance of an electrically operable mechanical valve. The method can improve valve operation over a range of operating conditions.

BACKGROUND

A system to operate and control one example of an electrically operable mechanical valve is described in U.S. Pat. No. 5,954,030. This patent presents a system for operating a dual coil pressure intensifying fuel injector for an internal combustion engine that is capable of injecting fuel directly into a cylinder of an internal combustion engine. The system controls fuel flow by adjusting the position of a spool valve within the fuel injector. The spool valve position is changed by flowing current to a charge coil or a discharge coil. When current is allowed to flow to the charge coil, the spool valve is attracted to the charge coil and fuel is allowed to enter an intensifier chamber. When current is allowed to flow to the discharge coil, the spool valve is attracted to the discharge coil and fuel is compressed in the intensifier chamber and released to the cylinder at a higher pressure. The charge and discharge coils position the spool valve so that the working fluid (i.e., pressurized oil), acts on the intensifier piston to compress the fuel in the intensifier chamber or to return of the intensifier piston so that lower pressure fuel may enter the intensifier chamber. The pressurized oil acts on the intensifier piston and transmits force to a second piston that pressurizes incoming fuel. By transmitting force from the larger area intensifier piston to the smaller area second piston, the fuel pressure is multiplied. In addition, the patent provides for a method of holding the spool valve in place, using residual magnetism at the first coil, until current in the second coil reaches a level that can quickly move the spool valve when the magnetic force produced by the second coil exceeds the "latching" magnetic force at the first coil. The inventors claim that this method produces a snap action that improves the speed of injector operation.

The above system also has several disadvantages. Specifically, at lower ambient temperatures or when the viscosity of the working fluid increases, the meniscus forces and other forces in the oil that occupies the space between the spool valve and the valve body can increase to a level that may be difficult to overcome, even when the magnetic field from the coil is at a high level. Further, the fuel injector performance may degrade causing the engine air-fuel ratio to deviate from a desired engine air-fuel ratio. Consequently, engine performance and emissions may also degrade.

SUMMARY

One embodiment of the present description includes a method for improving the operation of an electrically controlled actuator, the method comprising: applying a current to a coil of an electrically operable mechanical valve, said current at a frequency that is above the natural frequency of said mechanical valve and said current at a level sufficient to produce a power density at said coil to substantially raise the temperature of an armature of said electrically operable mechanical valve. This system and method overcome at least some of the limitations of the previously mentioned method.

Performance of an electrically actuated mechanical valve can be improved by eddy current and/or hysteresis heating. Specifically, eddy current and/or hysteresis heating allows heat to be targeted to metal objects that are near the coil being excited. For example, the region between a spool valve and a control coil that is used to move the spool valve can be heated by using a time-varying current. The current produces a time-varying magnetic field that induces current to flow in the metallic spool valve and surrounding metal components. Consequently, the eddy currents are dissipated in the metal and converted into heat energy. The heat also warms any surrounding material, such as the oil film which lies between the spool valve and the magnetic pole piece or "endcap". By heating the oil, the viscosity of the oil is decreased and the coefficient of friction between the spool valve and the valve body can be decreased. Consequently, a lower magnetic force may be used to move the spool valve to a desired position.

The present description can provide several advantages. For example, targeted valve heating can reduce the energy used to operate an electrically operable mechanical valve at lower temperatures. In other words, electrical energy can be used to heat a valve and lower meniscus and viscous forces that impede valve movement, rather than using electrically induced magnetic forces against valve stiction forces. In this way, electrical energy may be efficiently used to prepare the valve for operation rather than attempting to overcome forces that may be above a particular magnetic force that is produced by a particular current level. Further, heating can be advantageously targeted to specific areas of a valve where heat is desired. For example, current may be supplied to a valve at a frequency and power density that promotes heating at the interface between a mechanical valve and a valve guide. As a result, less time and energy may be necessary to change the viscosity of the oil that lies between mating surfaces of a valve. Further, in function specific electrically operable mechanical valves, such as fuel injectors for example, valve performance can leaded to improved engine starting because a more consistent fuel charge may be delivered when the engine is started at colder temperatures. That is, the fuel injectors can be heated to temperatures where the injector response may improve. Consequently, engine emissions may be improved because there may be fewer circumstances where the engine air-fuel ratio deviates from a desired value.

The above advantages and other advantages, and features of the present description will be readily apparent from the following detailed description of the preferred embodiments when taken alone or in connection with the accompanying drawings.

BRIEF DESCRIPTION OF THE DRAWINGS

The advantages described herein will be more fully understood by reading an example of an embodiment, referred to herein as the Detailed Description, when taken alone or with reference to the drawings, wherein.

DETAILED DESCRIPTION

The present description anticipates a variety of applications wherein the present description can be used to advantage. For example, the present description may be used to improve operation of two position spool valves, three position spool valves, pintle needle valves, valves that are operated by single or multiple coils, poppet valves, ball valves, gate valves, piezoelectric devices, and butterfly valves. Further, the present description may be applied in a variety of fields including automobiles, aircraft, process industries, mining, and manufacturing. Accordingly, this description is not intended to limit the scope or breadth of the claims or disclosure.

Electrically operable mechanical valves vary in design and construction. They may also be operated over a wide range of environmental conditions. Further, it may be desirable to provide different types of heating for different valve designs and/or during different operating conditions. A partial but not limiting list of other anticipated electrically operable mechanical valves includes solenoid valves, transmission spool valves, brake control valves, and engine poppet valves. Further, the description provides internal combustion engine fuel injectors as one example of electrically operable mechanical valves wherein the benefits of the present description can be illustrated.

Figure 1:
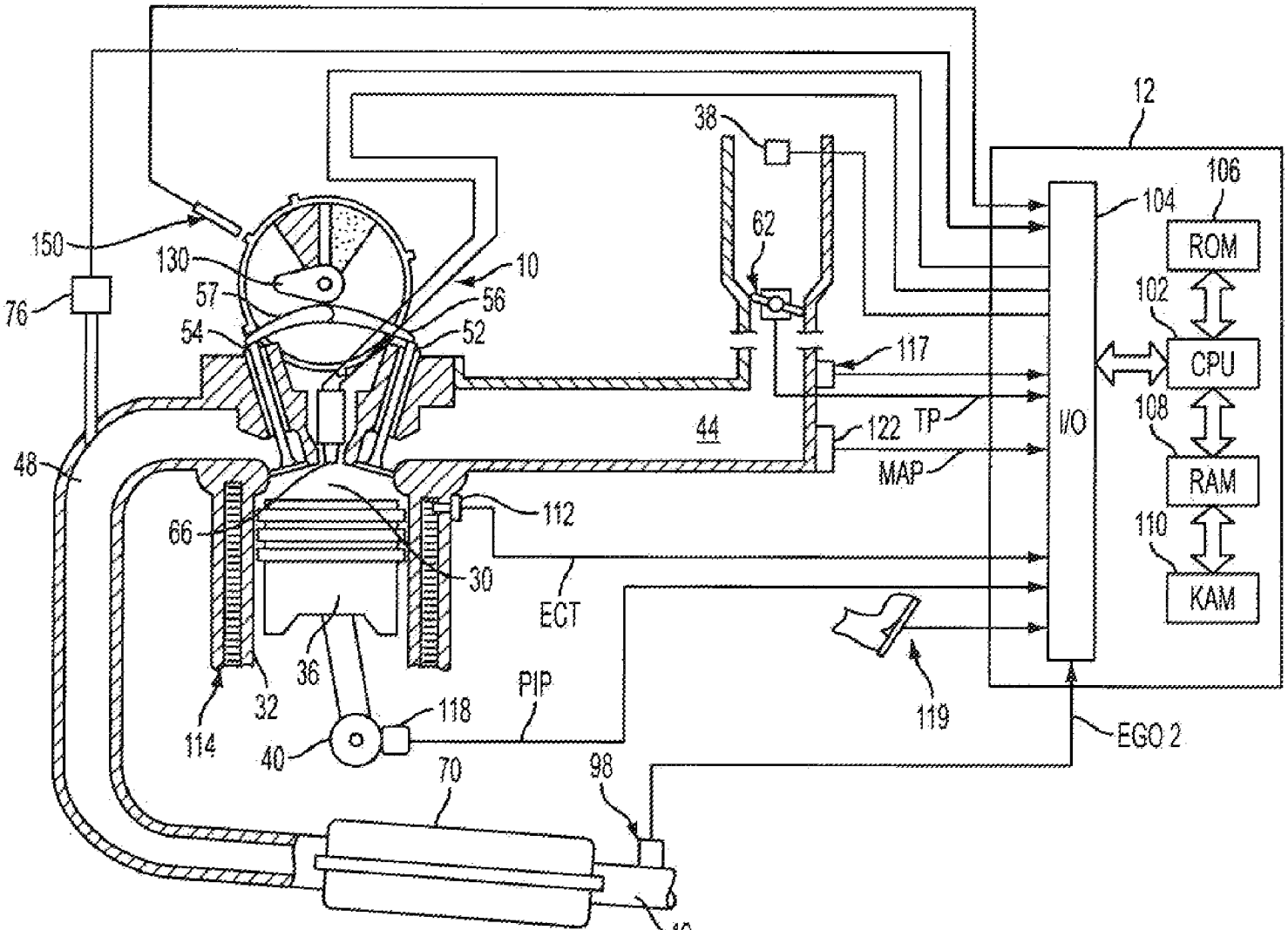
FIG. 1 is a schematic diagram of an engine.

Referring to FIG. 1, internal combustion engine 10, comprising a plurality of cylinders, one cylinder of which is shown in FIG. 1, is controlled by electronic engine controller 12. Engine 10 includes combustion chamber 30 and cylinder walls 32 with piston 36 positioned therein and connected to crankshaft 40. Combustion chamber 30 is known communicating with intake manifold 44 and exhaust manifold 48 via respective intake valve 52 and exhaust valve 54. Intake manifold 44 is shown communicating with optional electronic throttle 62.

Fuel is directly injected into combustion chamber 30 via fuel injector 66. The fuel injector is an example of an electrically operable mechanical valve. Fuel injector 66 receives opening and closing signals from controller 12. Camshaft 130 is constructed with at least one intake cam lobe profile and at least one exhaust cam lobe profile. Alternatively, the intake cam may have more than one lobe profile that may have different lift amounts, different durations, and may be phased differently (i.e., the cam lobes may vary in size and in orientation with respect to one another). In yet another alternative, the system may utilize separate intake and exhaust cams. Cam position sensor 150 provides cam position information to controller 12. Intake valve rocker arm 56 and exhaust valve rocker arm 57 transfer valve opening force from camshaft 130 to the respective valve stems. Intake rocker arm 56 may include a lost motion member for selectively switching between lower and higher lift cam lobe profiles, if desired. Alternatively, different valvetrain actuators and designs may be used in place of the design shown (e.g., pushrod instead of over-head cam, electro-mechanical instead of hydro-mechanical).

Fuel is delivered to fuel injector 66 by a fuel system (not shown) including a fuel tank, fuel pump, and fuel rail (not shown). Engine 10 may be designed to operate on one or more fuel types such as diesel, gasoline, alcohol, or hydrogen.

A distributorless ignition system (not shown) may provide ignition spark to combustion chamber 30 via a spark plug (not shown) in response to controller 12. Universal Exhaust Gas Oxygen (UEGO) sensor 76 is shown coupled to exhaust manifold 48 upstream of catalytic converter 70. Two-state exhaust gas oxygen sensor 98 is shown coupled to exhaust pipe 49 downstream of catalytic converter 70. Converter 70 may include multiple catalyst bricks, particulate filters, and/or exhaust gas trapping devices.

Controller 12 is shown in FIG. 1 as a conventional microcomputer including: microprocessor unit 102, input/output ports 104, read-only memory 106, random-access memory 108, keep-alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 119 coupled to an accelerator pedal; a measurement of engine manifold pressure (MAP) from pressure sensor 122 coupled to intake manifold 44; engine knock sensor (not shown); fuel type sensor (not shown); humidity from humidity sensor 38; a measurement (ACT) of engine air temperature or manifold temperature from temperature sensor 117; and an engine position sensor from a Hall effect sensor 118 sensing crankshaft 40 position. In a preferred aspect of the present description, engine position sensor 118 produces a predetermined number of equally spaced pulses every revolution of the crankshaft from which engine speed (RPM) can be determined.

Figure 2B:
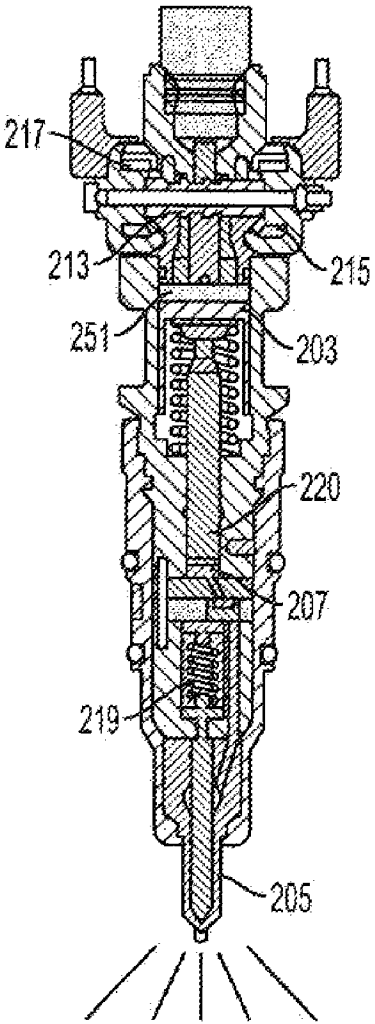
FIG. 2B is a cross-section schematic of an example electrically operated mechanical valve in an open position.
Figure 2A:
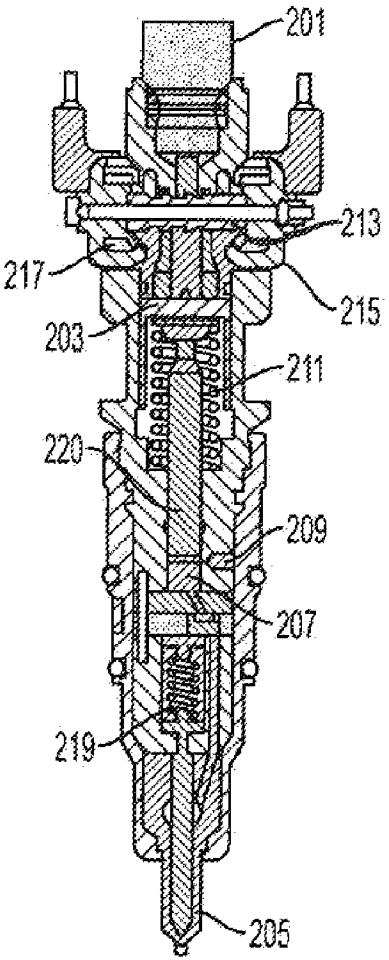
FIG. 2A is a cross-section schematic of an example electrically operated mechanical valve in a closed position.

Referring now to FIG. 2A, a cross-section schematic of an example electrically operable mechanical valve is shown. In particular, a fuel injector in the closed position is shown. Oil enters the fuel injector at port 201. The position of spool valve 213 controls the flow of working oil through the injector. Opening coil 217 is used to open spool valve 213 and closing coil 215 is used to close spool valve 213. In the open position, the spool valve allows the oil to intensify or increase the fuel pressure. In the closed position, the spool valve allows oil to flow from the intensifier and decrease the fuel pressure. Return spring 211 acts against the oil pressure via piston 203 and forces oil out of the injector when spool valve 213 is in the closed position. Fuel is fed into the injector via port 209 and is acted upon by intensifier piston 220 in chamber 207. When the fuel pressure reaches a predetermined level, pintle 205 opens and fuel is discharged to combustion chamber 30. When the fuel pressure lowers, spring 219 returns the pintle to the closed position and fuel flow stops.

Referring now to FIG. 2B, a cross-section schematic of an example fuel injector in the open position is shown. The figure shows the working oil displacing volume 251 above piston 203. This causes intensifier piston 220 to apply pressure to intensifier chamber 207, thereby reducing the intensifier chamber volume and increasing the fuel pressure. The fuel pressure overcomes the force of spring 219 and opens pintle 205 releasing fuel into the combustion chamber. Note that spool valve 213 is positioned against the pole face of coil 215 while it is positioned against the pole face of coil 217 in FIG. 2A.

Electrical current can be used to heat an electrically operable mechanical valve though resistance, hysteresis, and/or eddy currents. By heating a fuel injector the injector performance can be made more uniform over a wider range of engine and/or fuel injector operating conditions. When eddy current or hysteresis heating is used, the coil produces a time-varying magnetic field that generates eddy currents in nearby metallic structures. The eddy currents are opposed by the internal resistance of the structure and are transformed into thermal energy. Eddy current and/or hysteresis heating methods provide a way to project electrical energy away from the actuator coils. Further, the actuator coils are also heated during eddy current and hysteresis heating. That is, a time-varying current can be supplied to a coil to produce a time-varying magnetic field that induces eddy currents and hysteresis in nearby metallic components while also creating $I^2R$ losses at the coil. Eddy current heating, hysteresis heating, and the $I^2R$ losses can be adjusted by varying the current offset from zero, the current duty cycle, the current amplitude, and/or the current frequency.

On the other hand, the internal resistance of the actuator coils can also be used to heat an electrically operable mechanical valve while few eddy current are produced. As current flows into a coil, it is limited by the coil's internal impedance. Some of the electrical energy is converted to thermal energy. As a result, the temperature of the coil increases. This heat can be transferred to the surrounding electrically operable mechanical valve by conduction.

Figure 3B:
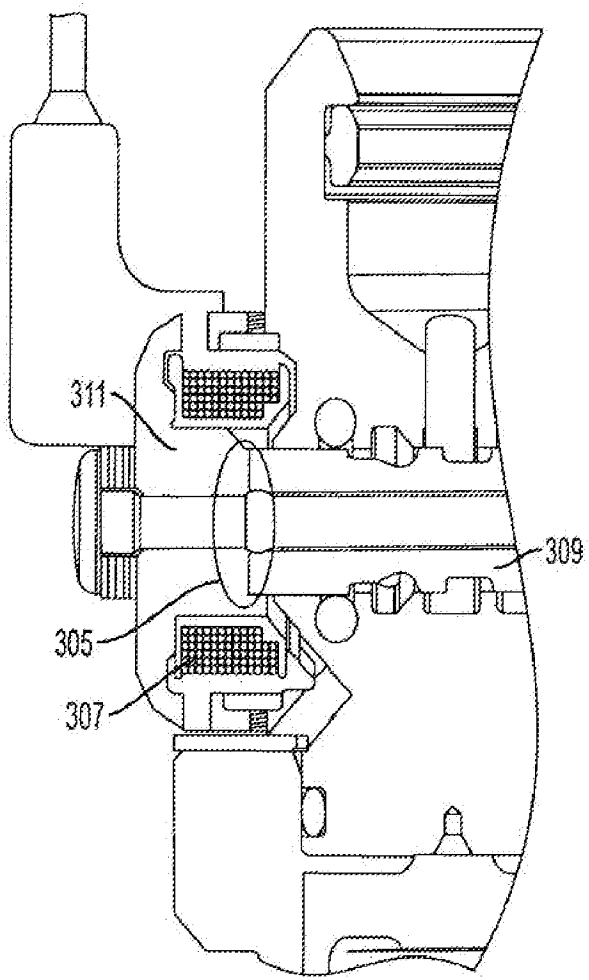
FIG. 3B is a cross-section schematic of targeted heating by eddy currents and/or hysteresis of an example electrically operable mechanical valve.
Figure 3A:
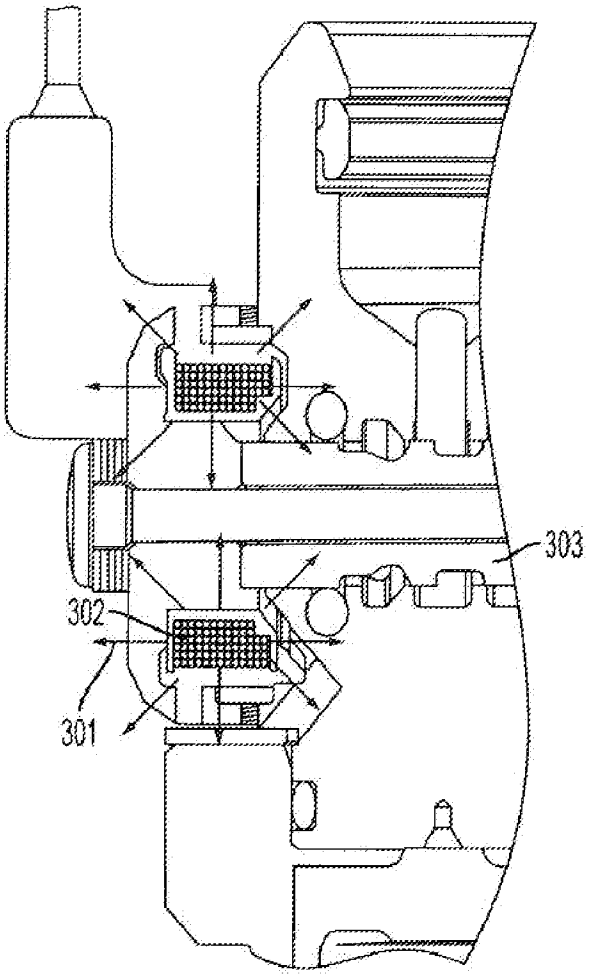
FIG. 3A is a cross-section schematic of an example fuel injector coil that illustrates heating of an electrically operable mechanical valve by conduction.

Referring now to FIG. 3A, a cross-section schematic of a portion of an example fuel injector coil is used to illustrate heating of an electrically operable mechanical valve using coil resistance. In one embodiment, current is passed through coil 302, the coil restricts the flow of current and transforms the electrical energy into thermal energy. Conduction allows heat to be transferred from the coil to the surrounding material, such as a spool valve and the remaining injector body. Consequently, this heat can be used to increase the temperature of oil that lubricates the interface between the spool valve and valve body. In addition, the heat can increase the temperature of the working oil that is used to pressurize fuel being delivered from the injector. By elevating the oil temperature, the viscosity of the working oil can be decreased. When the oil viscosity is lowered, less magnetic energy may be required to move the spool valve between the open and closed positions because the meniscus force or "stiction" between the mating surfaces can be effectively reduced. In addition, by heating the working oil, the response of the injector may be improved since the spool movement and hence the flow rate of oil that operates the injector may be improved. Thus, the temperature of fuel injector coils may be purposefully increased to improve operation of the fuel injector, at least during some conditions. Spool valve 303 is shown in the closed positioned, against the electromagnet pole face produced by coil 302. Vector 301 and similar vectors represent the paths that heat can take when coil 302 is used to generate heat.

Referring now to FIG. 3B, a cross-section schematic of a portion of an example fuel injector coil is used to illustrate heating of an electrically operable mechanical valve by eddy currents and/or hysteresis. In one embodiment, heat is targeted at the interface between the magnetic pole face and the spool valve, in region 305 for example. By applying a time-varying current to coil 307, a time-varying magnetic field is created by the coil. Eddy currents flow in metal that is exposed to this time-varying magnetic field, thereby causing the temperature of the metal to increase in endcap 311 and spool valve 309, for example. A fuel injector coil can induce such currents in the surrounding metallic components, such as a spool valve or a pintle. Consequently, a time-varying current supplied to an opening or closing coil can be used to transfer energy from a fuel injector control coil to a spool valve, for example. This allows heat to be produced where a large portion of the surface area contact between the spool valve and the endcap occurs. Heating this area of the injector can decrease the viscosity of the oil film interface between the spool valve and the endcap so that less magnetic force may be required to move the spool valve. Further, the heat can reduce the oil viscosity between the spool valve and the valve body, thereby reducing the oil shear forces and improving movement between these components.

In still another embodiment, current may be simultaneously passed through opening and closing coils to heat an electrically operable mechanically actuated valve without moving a spool valve that is controlled by the coils. When current is passed through both coils, at equal rates, the spool valve will stay positioned against the coil it lies against. This is because the magnetic force decreases with the distance between the magnetic pole face and the spool valve. Thus, assuming equal current, more force will be applied by the coil nearest the spool valve and the valve will be positioned accordingly. Note that it is also possible to use eddy current heating without moving the spool valve or pintle since it is possible to prevent the production of a DC magnetic field of sufficient magnitude and duration to move the spool valve. The electrically operable mechanical valve temperature rise can be increased because additional electrical energy can be directed to second coil, such that the transformation from electrical energy to thermal energy can be doubled. This can be desirable because current flow into a single coil may be limited so that the possibility of coil degradation may be reduced.

Figure 4:
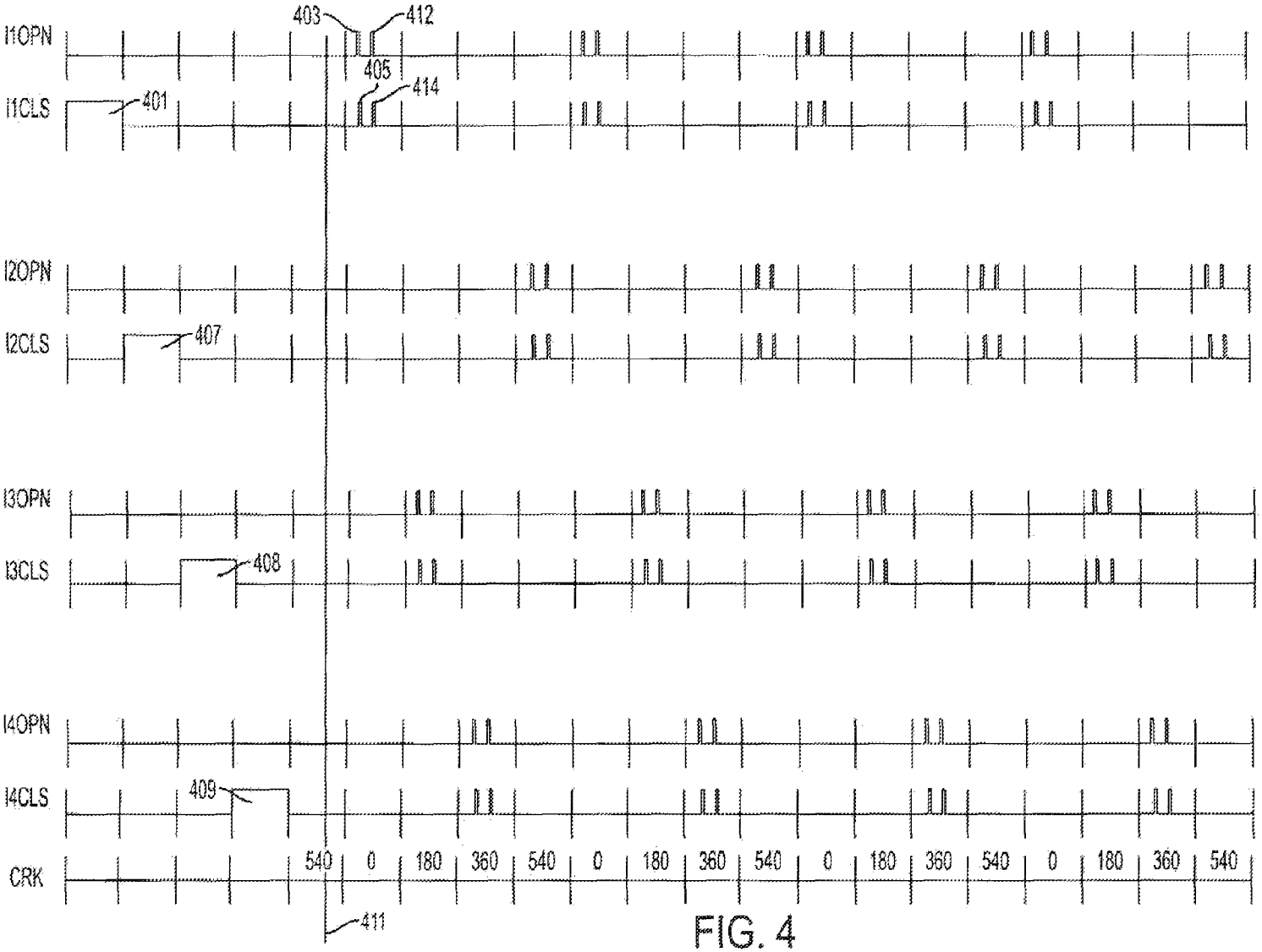
FIG. 4 is a timing sequence for an example engine starting sequence.

Referring now to FIG. 4, a timing sequence for improving injector operation during an example engine starting sequence is shown. This sequence may be generated by the method described in FIG. 8, for example.

FIG. 4 shows injector opening and closing coil command timing for a four cylinder engine. Vertical line 411 represents the initiation of engine rotation. Prior to engine rotation, the engine undergoes starting preparation. Starting preparation may include activating glow plugs to heat cylinders, allotting time for fuel pressure to build after a fuel pump is activated, and other similar functions. The amount of time reserved for starting preparation may vary with operating conditions, and as such, the starting preparation time shown in FIG. 4 is meant for illustration purposes only. It is not meant to limit the scope or breadth of the disclosure. Further, the time before marker 411 may be predetermined from empirical data and may vary with operating conditions.

The sequence flows from left to right. Injector command signals for fuel injectors are labeled on the left side of the figure. I1OPN identifies command signals that are sent to the opening coil of injector one. I1CLS identifies command signals that are sent to the closing coil of injector one. Commands for injectors 2-4 follow similar naming conventions. A high level indicates commands are sent to the coil during the period where the signal is high; however, actual coil commands may be different at different times during the illustration. Control commands may be voltage or current based depending on the design of the regulating controller. For example, label 401 identifies an interval where commands are sent to the closing coil of injector one before the engine is started. In this region, a time-varying command may be issued to the closing coil of injector one. In one embodiment, sufficient current (e.g., ten ampere, however, it can vary depending on the application) may be commanded at a frequency that is above the natural frequency of the mechanical valve portion of the fuel injector and at a power density that substantially raises the temperature (e.g., in some applications a power density that increases the initial temperature 10% over a 10 second period; in other examples, a power density that increases the initial temperature 1° C., 5° C., or 10° C. over a 10 second period; in other applications a power density that increases the initial temperature 10% over a 20 minute interval may be desirable depending on actuator mass, ambient conditions, and control objectives) of an armature.

In an alternative embodiment, current can be supplied at a frequency having a period that is less than the transit time that it takes for an electrically operable mechanical actuator being excited to move its armature from an open to a closed position, or vise-versa, at a particular current level. For example, where a current amount at a first level moves an armature in 0.2 seconds, a current frequency greater than 5 Hz can be applied. At another condition, where a current amount at a second level moves the previously mentioned armature in 0.1 seconds, a current frequency greater than 10 Hz can be applied. By exciting the electrically operable mechanical valve with a current at a frequency above the transit time, eddy current heating and hysteresis heating can be applied without substantially moving (e.g., ±2 mm in smaller actuators and ±4 mm in larger actuators) the actuator armature.

On the other hand, a single pulse may be issued to one or more coils of an injector, one or more times, without changing the injector state and before the operator is notified that the engine is prepared to start. Thus, it is possible to heat a fuel injector using coil impedance, eddy current, and/or hysteresis during the engine starting preparation period.

After starting marker 411, engine position can be identified from the markers that lie along the CRK signal. The CRK signal represents crankshaft position relative to top-dead-center of cylinder number one compression stroke. The numerical markers along the CRK signal are associated with the vertical markers that are immediately to the right of the markers.

During the period preceding starting marker 411, the injectors are sequentially heated by commanding current to flow to the closing coils. This is illustrated by the regions labeled 401, 407, 408, and 409. Notice that the command supplied to heat one fuel injector is stopped before the command is issued to another fuel injector. Alternatively, the injector heating command periods may overlap to some extent. In one example, the current flowing to heat the next fuel injector in a sequence can begin to flow before the current in the presently heated injector has completely stopped flowing. That is, a voltage can be supplied to an injector, thereby prompting current flow, while a voltage is withdrawn from another injector, but while current continues to flow within the injector as the magnetic field is collapsing. Furthermore, current flowing to a group of injectors may be decreased before current is increased to another group of injectors. Further still, injectors may be sequentially heated in the engine combustion order, if desired.

Figure 7:
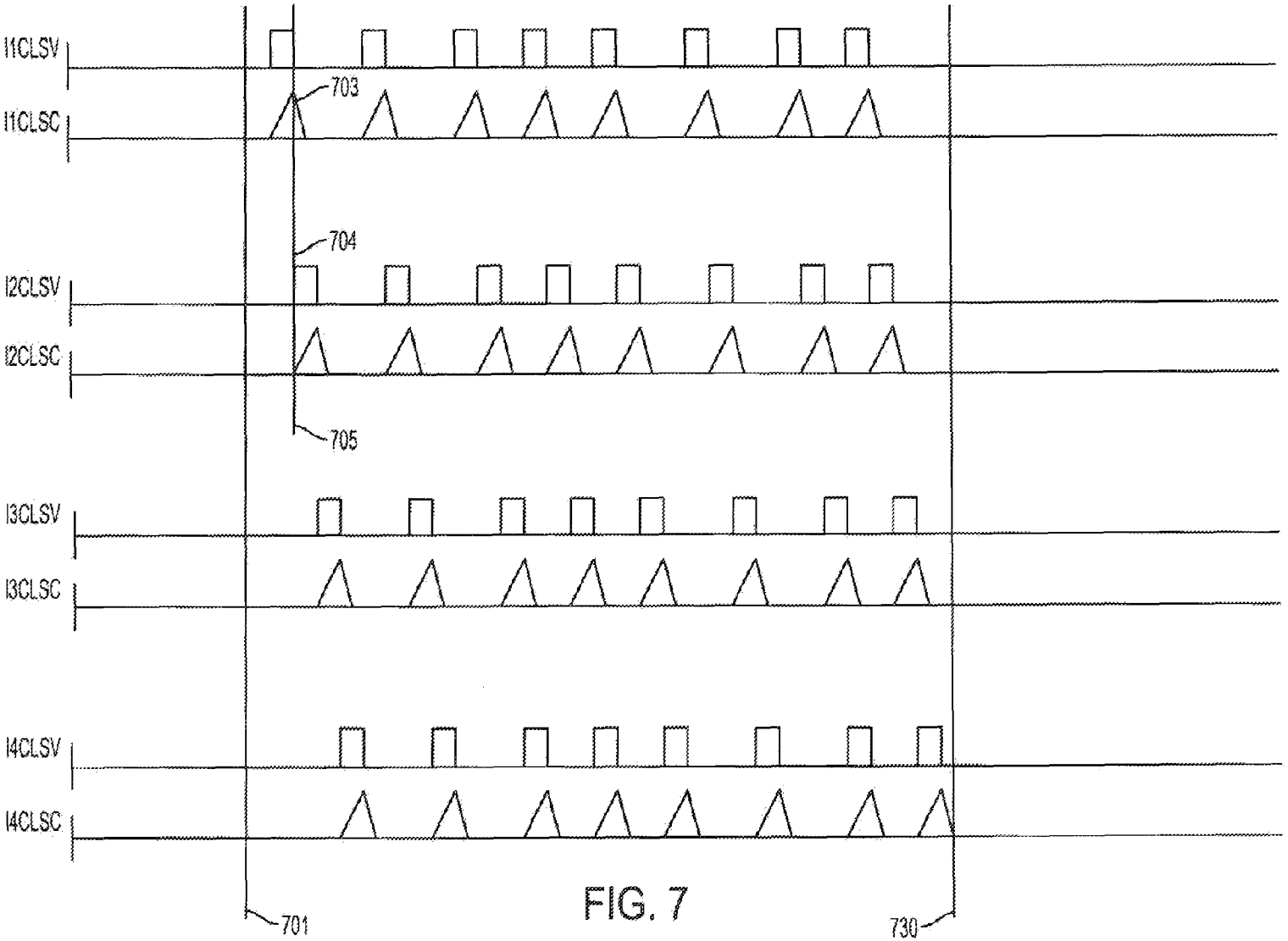
FIG. 7 is a timing sequence for another example engine starting sequence.

Although one sequential heating cycle is shown, this sequence may be repeated any number of times before the engine is started, see FIG. 7 for example. In addition, the duration of heating intervals may be varied as well as the type of heating desired (i.e., resistive, eddy current, hysteresis), for example. In one example, current may be supplied to a coil for 75 microseconds before advancing to the next coil in the heating sequence. In another sequence, current may be supplied to a coil for 60 milliseconds or longer before advancing to the next coil in the heating sequence. In addition, the total amount of time that a coil is used to heat a fuel injector during starting preparation or during engine running may be varied. For example, during a first set of operating conditions, an injector coil may be supplied heating current over a two second interval, during a second set of operating conditions the same coil may be supplied heating current over an eight second interval. In this way, the amount of energy used to heat an electrically actuated mechanical valve may be varied in response to operating conditions of the actuator, ambient conditions, or of an internal combustion engine, for example.

As previously mentioned, fuel injector heating may be accomplished by resistive, eddy current, and/or hysteresis heating. Accordingly, current can be delivered to a coil in a variety of ways.

In one embodiment of the illustration, eddy current heating may be used during the heating intervals to increase the fuel injector temperature. Eddy current heating may be initiated by alternating or pulsed current flow through a coil so that a time-varying magnetic field is created. Current may be alternated by stopping and starting flow or by continuously varying the current. In one example, current may be varied by applying a voltage in the form of a square wave, sine wave, or by band limited noise signal, for example. The current may be supplied by a uni-polar or bi-polar power source and may have a positive, negative, or no bias from zero. The magnetic field strength, and the eddy currents that it induces, can be related to the current that flows through the coil. Accordingly, the amplitude and frequency of current flowing through the coil can be varied to adjust the amount of heat generated by the coil. Further, the coil current may be comprised of one or more frequencies that may affect the formation of eddy currents. Higher frequencies (e.g., above 1 kHz) can be used to increase surface heating because higher frequencies tend to provide less material penetration so that eddy current heat is generated near the material surface. However, the performance of a particular frequency is expected to vary depending on the construction of the electrically operable mechanical actuator. In one embodiment, the current commanded to the coil of a fuel injector can be set above the natural frequency of the mechanical valve portion of the injector and the power density of the current can be set to a level that substantially increases the temperature of a region of the injector over a specified time interval (e.g., 2-15 seconds). This type of heating can be advantageous when it is desirable to heat oil surface films so that stiction may be reduced between two mating surfaces.

In another embodiment of the illustration, resistive heating may be used during the heating intervals to increase the fuel injector temperature. When resistive heating is desired, controller 12 of FIG. 1 can be programmed to flow a desired amount of current into a coil for a desired amount of time. Of course, the desired amount of current flowing into the coil may be varied during the period that current is flowing. But, the average current level can be set to a predetermined level and held at that level for a predetermined amount of time. In one embodiment, the predetermined amount of time can be correlated to the time it takes the current to raise the coil temperature to a predetermined level. When the coil temperature reaches the predetermined level current flow can be stopped. In other word, the coil temperature can be controlled to stay below a predetermined temperature. Also note the coil temperature may be regulated between a predetermined upper limit and a predetermined lower limit. In this way, the coil temperature can be managed while heat is transferred from the coil to the surrounding electrically actuated mechanically operable valve. In addition, the current flow can also be periodically restarted so that the coil continues to heat the surrounding injector body.

In still another embodiment of the present illustration, the proportions of eddy current, hysteresis, and/or resistive heating can be adjusted by controlling the current amplitude, frequency, and/or offset from zero. For example, a current that alternates between a low state of 2 amperes and a high state of 20 amperes at a frequency of 1 kHz may be supplied to the closing coil of a fuel injector. The average current supplied to the coil can be over 8 amperes. A portion of this current can be converted to heat by the resistive component of the coil. At the same time, the time-varying portion of the current can be used to generate a magnetic field and to target eddy currents in the region of the coil and spool valve interface. If the current is subsequently changed to alternate between 0 amperes and 15 amperes at a frequency of 1.5 kHz the resulting restive and eddy current heating proportions will change. Thus, the resistive, eddy current, and/or hysteresis heating proportions can be adjusted so that heating can be varied in response to operating conditions.

Returning to FIG. 4, before starting marker 411, the spool valve is kept in the closed position before the engine is started and during the heating process. Thus, the operating state of the fuel injector remains unchanged in terms of opening and closing or in terms of delivering fuel. Furthermore, there is substantially no fuel flow (e.g., less than 1 gm per min) through the injectors prior to starting marker 411. Of course, other variations to this sequence prior to starting marker 411 may also be useful. For example, the closing coils of a group of fuel injectors may be used to heat the fuel injectors in a sequential manner as illustrated. Then, the opening coils of the same group of fuel injectors may be used to also heat the fuel injectors in a similar sequential manner. In another variation, the position of an actuator armature or pintle may be moved before eddy current heat is applied to the actuator coil. These sequences may be repeated a number of times before the engine is started, if desired.

After the fuel injectors are pre-heated, the engine is started at vertical marker 411. As the engine is rotated the opening and closing coils move the spool valve from the closed position to the open position twice per cylinder cycle. That is, two injections of fuel are made every four strokes. The initial injector opening command, 403, for injector number one provides a pilot injection that prepares the cylinder for the second and main fuel injection, 412. Each injector opening command is followed by an injector closing command. The pilot injection is stopped by the command at marker 405, and the main injection pulse is stopped by the command at marker 414. Note that it is also possible to apply a time-varying current to the opening coil during the injection period, while the engine is rotating, so that the opening coil acts to heat the injector, if desired. The other cylinders follow a similar injection pattern; although, only a single injection may be desired during different operating conditions. The injectors are shown being operated in the compression stroke of the respective cylinder, but the injectors may be operated during any stroke of the cylinder cycle (e.g., intake, power, and/or exhaust). Further, the injectors are operated in order of cylinder combustion events, namely, 1-3-4-2 for a four cylinder engine.

Figure 5:
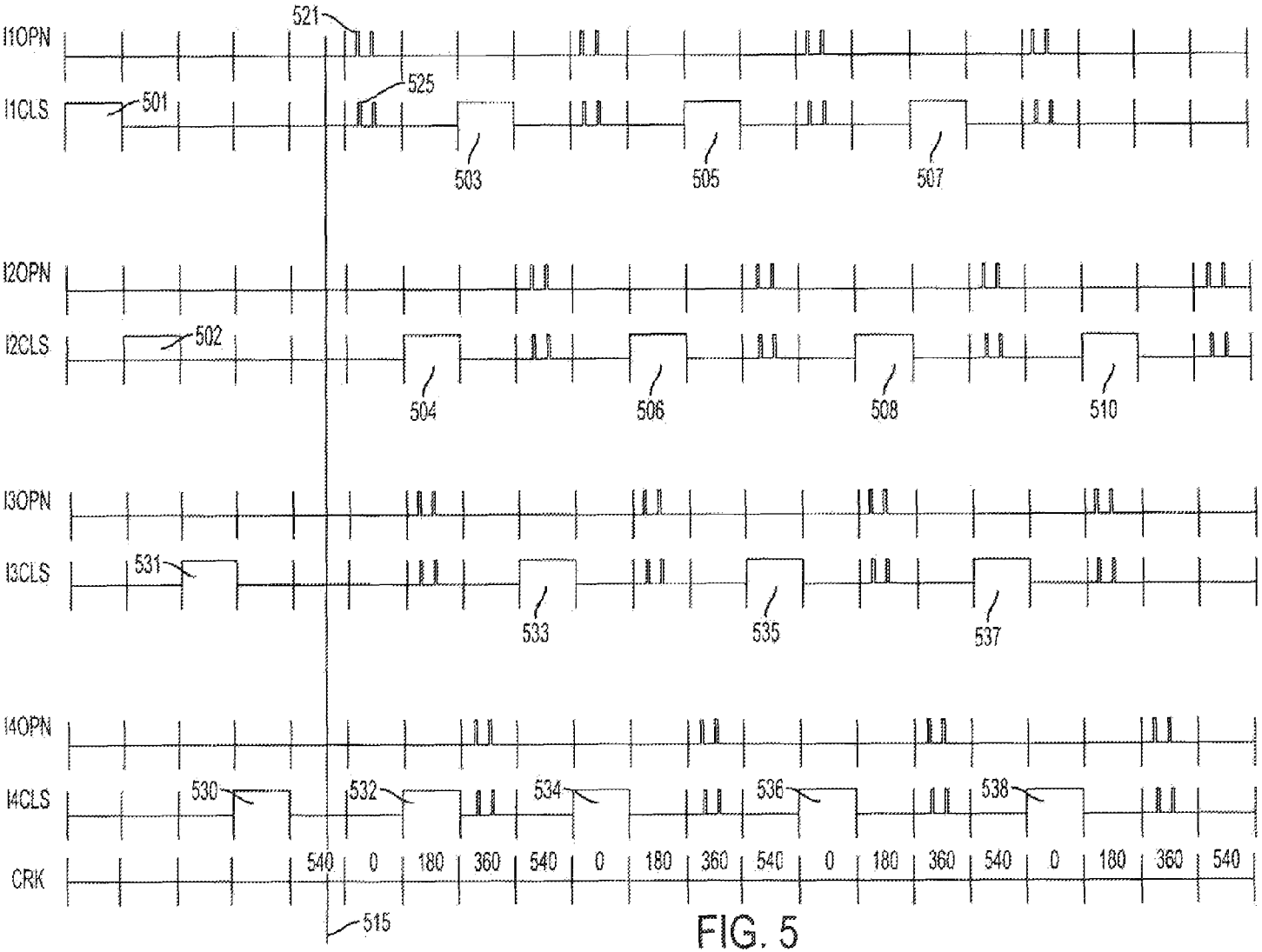
FIG. 5 is a timing sequence for another example engine starting sequence.

Referring now to FIG. 5, an alternative method to improve injector operating during an engine start is shown. FIG. 5 follows signal labeling that is similar to that which is shown in FIG. 4. Prior to starting the engine at vertical marker 515, the fuel injectors are heated in the regions illustrated by markers 501, 502, 531, and 530. Fuel is injected to the engine cylinder by coil commands similar to those illustrated by markers 521 and 525. Marker 521 identifies a pilot injection and marker 525 identifies stopping the pilot injection. The coil signals immediately following the pilot injection signals control the main fuel injection pulse width. The injectors may be heated using the resistive, eddy current, and/or hysteresis methods that are described above. After the engine begins to rotate at marker 515, the closing coils of injectors one through four are heated between injection events when the spool valve is in the closed position. Markers 503-508, 510, and 532-538 identify locations that fuel injector heating can be applied after an engine begins to rotate and is started. Again, injector heating in these areas may be accomplished by resistive heating, eddy current, and/or hysteresis heating or combinations thereof. Of course, the injector heating need not occur at the exact timing illustrated in the figure. Rather, injector heating may be initiated during any portion of the cylinder cycle where the desired state of the injector spool valve (open or closed) is not be changed by current entering the coil. For example, injector heating intervals 503, 505, and 507 can be moved from the 180-360 crankshaft degree interval to the 0-180 crankshaft degree interval, if desired. Further, it is possible to create eddy current heating from a coil without changing the state of the spool valve. As such, the fuel injector opening coil may be used to heat the fuel injector with eddy currents while the spool valve remains in the closed state. Further still, the fuel injector may be simultaneously heated using eddy currents from the opening and closing coils without changing the state of the spool valve since the DC magnetic field strength would be low. In addition, the heating duration may be changed if desired. For example, the heating duration may be increased if the injector is colder from one start to the next, or the heating duration may be decreased if the engine temperature increases at a higher rate from one start to the next. The heating intervals may be set for a predetermined amount of time or they may be set for a specific crankshaft interval, during a 100° crankshaft rotational window for example. It should also be noted that the heating intervals of one particular cylinder do not align with the heating interval of another cylinder. This arrangement was purposefully created to control the amount of current that is simultaneously delivered to the injector actuators. By offsetting the injector heating intervals, injector heating may be possible without significantly changing the power requirement of the engine. Alternatively, the fuel injector heating intervals may be made to overlap, if desired.

The injector spool valve is controlled in the same manner as described in FIG. 4. Namely, the opening and closing coils are operated twice during a cylinder cycle. Specifically, the injector is operated once for a pilot injection and once for a main injection, although, additional injections are possible if desired. During the warming period, the injector spool valve is held in the state it occupied prior to the warming interval. Alternatively, the warming sequence may be initiated when the spool valve is in the state opposite to that which is controlled by the heating coil. For example, the spool valve may be in the open position when current enters the closing coil. The current entering the closing coil can pull the spool valve into the closed position and then begin to provide heat to the injector. Thus, the heating process of an opening or closing coil may also be initiated by passing current through the coil and pulling the spool valve from the opposite state (i.e., the open or closed position). Then the coil can be used to heat the fuel injector.

Figure 6:
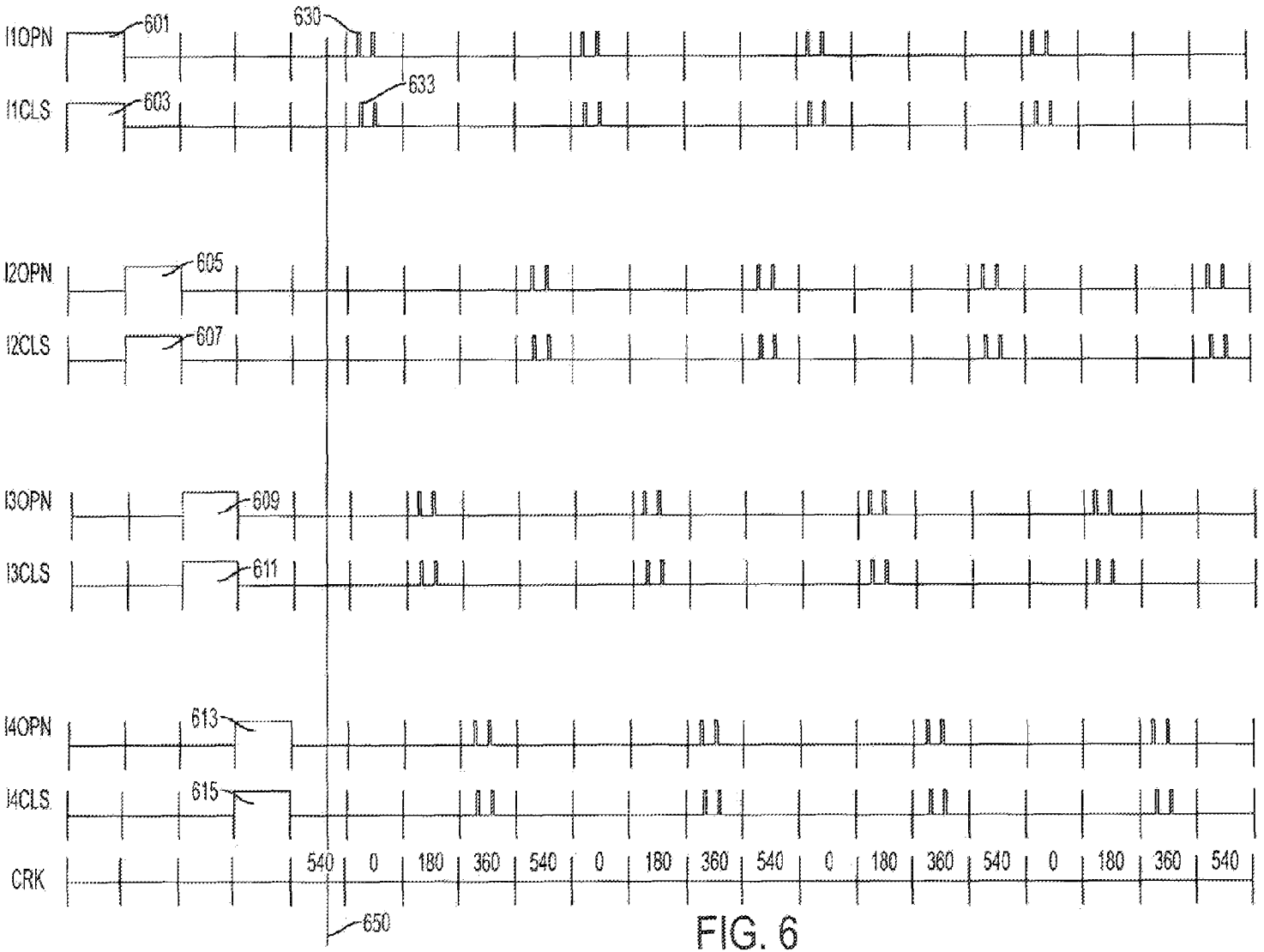
FIG. 6 is a timing sequence for another example engine starting sequence.

Referring now to FIG. 6, an alternative method to improve injector operating during an engine start is shown. FIG. 6 also follows signal labeling that is similar to that which is shown in FIG. 4. Prior to starting and rotating the engine at vertical marker 650, each pair of injectors is activated to heat the fuel injector. That is, the opening and closing coils of each cylinder are simultaneously supplied current to heat the fuel injector. Injector heating is illustrated by regions 601, 603, 605, 607, 609, 611, 613, and 615. When both coils are simultaneously provided equal amounts of current the spool valve stays in the state (open or closed) that it occupied prior to initiating current flow. The coil closest to the spool valve attracts and captures the valve because it applies more force to the valve than the opposite coil. When two coils are supplied current simultaneously, the fuel injector heating can be increased beyond the level that the single coil can provide. Notice that prior to vertical marker 650, the injector coil pairs are supplied current to heat the fuel injector in a sequential manner. That is, current is supplied to the opening and closing coils of injector one and then after current flow to injector one is stopped, current is allowed to flow to the coils of injector two. Alternatively, as previously mentioned, the coil heating intervals of two fuel injectors may be overlapped, if desired. The coils may provide resistive, eddy current, and/or hysteresis heating. Note that it is also possible to flow current to the injectors in an order that is different than that shown in FIG. 6. For example, current for injector heating may be allowed to flow to injectors based on the firing order of the engine (e.g., 1-3-4-2). Marker 630 identifies the beginning of a pilot injection and marker 633 indicates the end of pilot injection. The coil control signals immediately following the pilot injection commands are used to control the main fuel pulse width. Other coil command signals representing control of the fuel injector are shown in a similar manner. Also note that sequential fuel injector heating is not required. All fuel injectors or a group of fuel injectors may be simultaneously heated, if desired. Furthermore, groups of fuel injectors may be sequentially heated. For example, four groups of injectors, comprised of two injectors per group, may be heated sequentially when heating the fuel injectors of an eight cylinder engine.

Referring now to FIG. 7, example current and voltage timing for an alternative engine starting preparation method is shown. The sequence begins at the left side of the figure and terminates on the right side. Label I1CLSV represents voltage applied to cylinder number one injector closing coil. Label I1CLSC represents current flowing through cylinder number one injector closing coil. Similar labels, currents, and voltages are illustrated for cylinder number two through four injectors. Vertical reference 701 illustrates a key-on or similar engine start request. And vertical reference 730 indicates a ready-to-start condition.

The heating process begins shortly after the start request signal 701 is identified. A voltage is applied to the closing coil of cylinder number one injector for a predetermined period of time. The period of time may be a function of engine temperature, injector temperature, engine oil temperature, engine coolant temperature, time since last start, or other similar references. Current begins to flow to the closing coil and increases until the voltage is removed at vertical reference 705. The changing current induces a magnetic field in response to the current. Voltage is removed from cylinder number one injector coil at vertical reference 705, and current flow through the coil decays from as the magnetic field generated by the coil begins to collapse 703. Voltage is also applied to cylinder number two injector closing coil at vertical reference 704, which occurs nearly simultaneously with the voltage being removed from cylinder number one injector. Again, the current begins to rise as voltage is applied to the injector coil. In this way, can be applied voltage sequentially to each closing coil of the respective injectors, thereby reducing the instantaneous current supplied to heat the injectors. Further, the changing current in the injectors creates a time-varying magnetic field that can induce eddy currents and/or magnetic hysteresis in nearby metal. Thus, the illustrated heating sequence can be used to heat injectors while limiting the amount of current that is supplied to the injectors. In this example, eight sequential voltage application cycles are illustrated before the ready-to-start condition is met, however, the number of sequential heat generating cycles may be increased or decreased as desired. For example, during cooler whether ten thousand individual voltage applications may be commanded to each injector coil, whereas during warmer conditions, two thousand voltage applications per injector may be commanded.

Figure 8:
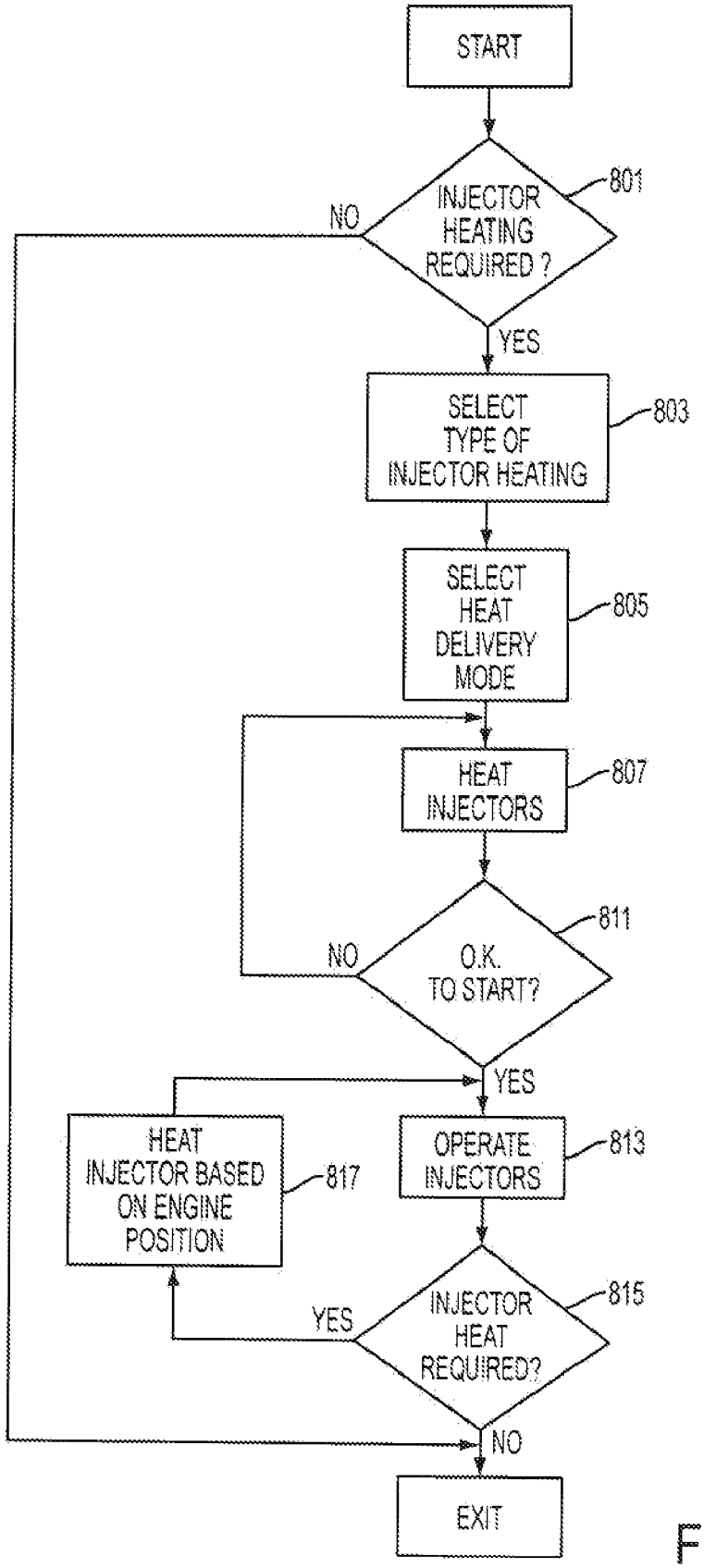
FIG. 8 is an example flow chart of a method to improve fuel injector control during the start and running of an internal combustion engine.

Referring now to FIG. 8, a flow chart of an example fuel injector heating method is shown. In step 801, the routine determines if fuel injector heating has been requested. The request for injector heating may come from an external routine or it may result from evaluating the state of sensors and systems. In one example, the states of engine temperature, time since last engine start, oil temperature, and injector coil temperature are used to determine if injector coil heating is desired. Further, operating conditions can be used to determine the duration of fuel injector heating. In one example, the fuel injector heating duration may be determined by retrieving empirically determined heating times from memory. Specific memory locations may be interrogated by indexing arrays that are organized by engine coolant temperature and engine oil temperature, for example.

In one example, fuel injector heating is commenced as an engine is prepared to start. Starting preparation may be initiated by an operator command or by a command from an external system, such as a hybrid vehicle controller. Fuel injector heating may also be accomplished using a voltage or current level that is higher or lower than that which is used during fuel injection events. By varying the voltage and/or current level, varying amounts of heat may be produced by the injector coil. If heating is requested the routine proceeds to step 803. If not, the routine proceeds to exit and the fuel injectors can be operated to deliver the desired fuel.

In step 803, the injector heating method is selected. That is, the routine selects to heat the fuel injector through eddy current heating, resistive heating, or chooses not to heat the injector. The heating method may be programmed to be uniform for all conditions (e.g., eddy current heating may be used at all times) or different heating methods may be used in response to different operating conditions. For example, if oil temperature is low, eddy current heating and its associated $I^2R$ resistive heating may be used to increase the fuel injector temperature. On the other hand, at warmer temperatures it may be desirable to heat the fuel injector with primarily resistive heat. Further still, the fuel injector heating method may be selected in response to operating conditions, such as the state of charge of a battery or the power output of an alternator or generator. In one embodiment, resistive fuel injector heating is permitted when the battery state of charge is above a desired level, and resistive fuel injector heating is not permitted when the battery state of charge is below the desired level. Alternatively, eddy current injector heating may be accomplished in the same manner. In another embodiment, eddy current heating is permitted at one state of the vehicle charging system, and resistive heating is allowed at a different state of the vehicle charging system. Note that it is also possible to change the fuel injector heating profile by adjusting the average current entering the coil as well as by altering the frequency and amplitude of the current entering the coil.

In one embodiment, the frequency of current supplied and/or commanded to an electrically operable mechanical valve can be at a frequency that is greater than the natural frequency of the mechanical valve portion of the electrically operated mechanical valve. Further, power density of the current supplied to the electrically operable mechanical valve can be controlled to a level that substantially raises the temperature of a portion or region of the electrically operated mechanical valve.

In one embodiment, the natural frequency of a mechanical valve can be described as a second order system expressed as:

$$M\ddot{x}+B\dot{x}+Kx=F(i)$$

Where M is the valve mass, B is the damping coefficient, K is a spring constant, and F is the force applied to the system as a function of current. The natural frequency $W_n$ of this system can be described as:

$$W_n = \sqrt{\frac{K}{M}}$$

If the electrically operated mechanical valve is a first order system it can be represented by:

$$M\ddot{x}+B\dot{x}=F(i)$$

When $v=\dot{x}$ and taking the Laplace transform yields:

$$sv + \frac{B}{M} = \frac{F(i)}{M}$$

and $$\frac{v}{F(i)} = \frac{1/M}{s+(B/M)}$$

having a natural frequency of $W_n$=B/M. When current is supplied at a frequency above the natural frequency of the valve, the electrical energy entering the coil can be directed to an area of the electrically operable mechanical valve that lies outside of the actuator coil without having to move the valve or armature.

The power density can be described as metered coil output power divided by the armature or workpiece surface within the coil and may be expressed as watts/centimeter squared. And the power density of the coil is determined by the current flowing into the coil.

For eddy current and hysteresis heating of electrically operable mechanically actuated valves, current is supplied in a manner that increases a magnetic field strength and eddy current when a temperature is lower and decreases a magnetic field strength and eddy current when a temperature is higher. The before-mentioned temperature may be a temperature of the electrically operated mechanically actuated valve or of a nearby object, such as an internal combustion engine oil or water temperature. Accordingly, a temperature can be used to index tables or functions that define specific current frequencies and amplitudes that heat the actuator in a desired manner. After the fuel injector heating method is selected the routine proceeds to step 805.

In step 805, the fuel injector heating delivery mode is selected. The heating mode describes how and when the type of heating selected in step 803 is delivered to one or more fuel injectors. For example, in one heating mode heat may be delivered to fuel injectors in a sequential manner where the amount of heat delivered to each injector is varied in response to operating conditions.

In one embodiment, the heating delivery mode can be split into two regions. Namely, the time before the engine is started and the time after the engine is started. Heat may be delivered to the fuel injectors before a start in a way that may be different from the way that heat is delivered after a start. For example, before the engine begins to rotate the heating sequence may be based on time. That is, current is sent to heat a different individual injector every 200 milliseconds, for example. After the engine is started, heat may be delivered at predetermined crankshaft intervals for a predetermined duration. In one embodiment, the heating duration may be reduced or increased based on the state of the battery or charging system. Specifically, if the battery state of charge is low the heating duration may be shortened during the engine starting preparation phase and then fuel injector heating may be resumed after the engine is started so that the injector performance may be improved.

This flexibility allows heat to be delivered to the fuel injectors in response to operating conditions. For example, it may be desirable under some engine operating conditions to deliver heat to the fuel injectors before a start but not after a start, or vice-versa. Further, the injector heating duration, that is, the time or crankshaft angle that heat is delivered to a fuel injector, may be varied with engine operating conditions. This allows fuel injector heating to be tailored to the requirements of the system. Of course, the injector heat delivery mode can be varied similarly in response to electrical and/or charging system conditions (e.g., the state of charge of a battery).

Fuel injector heating may be delivered to the injectors simultaneously; to groups of injectors where the injectors of a group are simultaneously heated, and where the injector groups are heated at different times; sequentially; or in combinations of the before-mentioned ways. In one embodiment, current is supplied to two or more fuel injectors simultaneously. That is, current for injector heating the injectors is delivered at substantially the same time. Alternatively, it is also possible to deliver current to heat the injectors sequentially. For example, current for injector heating can be supplied to a first injector, stopped, supplied to a second injector, stopped, and continued in the same manner to the remaining injectors. Further, this sequence may be repeated until operating conditions, such as time since key-on has reached a predetermined level or until engine oil temperature reaches a desired level, for example. As mentioned above, after the engine is started, the fuel injector heating may be continued or may be stopped. Engine operating conditions, heating duration, and/or heating energy may be used to determine when to deactivate injector heating. The heating mode and the timing when heat is delivered to the fuel injectors may also be varied as the engine begins to rotate.

FIG. 5 shows one example of a fuel injector heating delivery mode that is available from the present description. Specifically, injector heating is delivered at predetermined crankshaft intervals so that the heating does not interfere with injector operation. Further, it is also possible to briefly deactivate heating to one injector if current is needed to actuate another fuel injector during the same crankshaft interval. For example, if fuel injector heating is scheduled for cylinder number four fuel injector between 540 and 0 crankshaft degrees referenced to top-dead-center of cylinder one, and fuel injection is scheduled for cylinder number one during this same interval, then the heating for cylinder four fuel injector may be deactivated while injection commands are issued to the cylinder number one fuel injector.

Continuing with step 805, the heating mode may be determined by assessing engine operating conditions, injector operating conditions, and/or charging system operating conditions. In one embodiment, the operating conditions may be used to exercise a state machine that can activate different heat delivery modes before and after starting. The selection of these heat delivery modes may be empirically determined, for example. FIGS. 4-6 provide a sample of the available heating modes that may be selected. The routine proceeds to step 807 after the heat delivery mode is selected.

Referring now to step 807, the fuel injectors are heated. As previously mentioned, the fuel injectors may be heated by resistance, eddy currents, and/or by hysteresis heating. In one embodiment, the heating process may be initiated by an opening a vehicle door or from a door unlock signal.

As mentioned above, the resistive heating method uses the internal resistance of the fuel injector coil to heat the injector components that surround the coil. The coil heat is transferred to the surrounding material through conduction. The coil resistance transforms the electrical energy entering the coil into thermal energy. By applying a controlled current to the fuel injector coil, the temperature of the injector coil may be regulated so that the coil transfers a desired amount of thermal energy to the surrounding injector while maintaining the temperature of the coil below a predetermined level. In one example, a three ampere RMS current flows into the injector coil while the spool valve is already positioned at or near the coil that the current is flowing into. The current increases the coil temperature and produces a magnetic field that acts on the spool valve that controls fuel flow within the injector. However, since the spool valve is already at or near the coil, the magnetic field has no effect on the fuel that flows in the fuel injector. Thus, the injector is heated without changing the injector's fuel flow.

On the other hand, the above-mentioned eddy current heating method generates a time-varying magnetic field by varying the current that flows into a coil. The current may be varied in a variety of ways. For example, the current entering the coil may be increased and decreased over a specified time interval, or if the engine is rotating, the current may be increased or decreased over a specified crankshaft interval (e.g., The excitation frequency may be adjusted by a predetermined amount every 360 crankshaft angle degrees. Thus, the heat energy delivered to an injector can be varied based on the number of engine revolutions or combustion events). The current may be increased and/or decreased in a pattern that follows a square wave, sine wave, or triangle wave, for example. As the current varies, a magnetic field is generated that induces current to flow in the coil core and the spool valve. This current is opposed by the resistance of the material and is thereby transformed into heat that warms the fuel injector.

The current flow to the coil may be controlled by a single device, such as a transistor, or it may be controlled by several devices that form an H bridge that allows bi-directional current flow, for example. Thus, the average value of current flowing into the coil may be positive, negative, or zero while the fuel injector is being heated.

Also note that the fuel injection timing may be adjusted as a function of the time fuel injectors are heated or as the amount of heating energy supplied to a fuel injector varies. For example, at a constant engine speed and load, the fuel injection pulse width may be decreased as the amount of heat energy supplied to a fuel injector increases. This feature allows an engine controller to compensate for the improved response of a heated injector. After the coils start to heat, the routine proceeds to step 811.

In step 811, the routine determines whether or not the engine is ready to start after injector heating has commenced. In one embodiment, if the injectors have reached a desired temperature or a time since key-on, the engine controller 12 can notify the operator that the engine is ready to start or the engine may be started in other circumstances. In other embodiments, the engine may be considered ready to start after a desired amount of heating energy has been supplied to one or more injectors. For example, the engine may be considered ready to start if a predetermined number of joules have been dissipated by each fuel injector. If the routine determines that the engine is ready to start the routine proceeds to step 813. Otherwise, the routine returns to step 807.

In step 813, the injectors are controlled so that the desired amount of fuel is injected to the cylinders at the desired timing. In other words, the fuel injectors are operated in a manner that is similar to conditions when injector heating is not desired. That is, the injectors are controlled such that they inject fuel into the cylinder one or more times during a cycle of a cylinder. During the portion of the cylinder cycle where the fuel injector operates, the opening coil moves the spool valve at least once by magnetically attracting the spool valve to the opening coil, thereby injecting fuel into a cylinder. Similarly, the closing coil moves the spool valve from the opening coil to stop fuel flow to the cylinder. In one example, the fuel is injected during the intake stroke or during the compression stroke. The amount of fuel injected is determined from the operator demand, engine speed, and operating conditions. The routine proceeds to step 815 after the fuel injection commands are determined and commanded.

In step 815, the routine determines if fuel injector heating is desired while the engine is operating. If it is, the routine proceeds to step 817. If not, the routine proceeds to exit. If no fuel injector heating is desired during engine operation, the injectors are operated by the main fuel injection routine and fuel is delivered in response the engine speed, operator demand, and operating conditions.

In step 817, the fuel injectors are heated by applying current to the opening and/or closing coil such that the normal operation of the injector is unchanged. That is, current flows to an opening and/or closing coil when the spool valve is already positioned at or near the coil that current it applied to. Alternatively, current may be applied to both opening and closing coils such that the spool valve remains substantially stationary. For example, if the spool valve is positioned against the closing coil, current may be applied to the closing coil and then to the opening coil so that the magnetic field applied by the closing coil provides enough force to the spool valve to keep it positioned against the closing coil.

While the engine is being operated, it is desirable to keep the fuel injectors delivering a commanded amount of fuel. This can be accomplished by heating the injector during the portion of a cylinder cycle where the injector spool valve is not shuttling between the open and closed position. For example, the fuel injectors may be heated during the power or exhaust strokes. FIG. 5 shows an example of heating the fuel injectors while the engine is operating. Of course, the fuel injector heating interval may be varied from that which is shown in FIG. 5, if desired. One convenient way to achieve heating during engine operating is to time the heating period with engine positions. That is, the heating interval can be between bottom-dead-center of the exhaust stroke and top-dead-center of the exhaust stroke of the cylinder associated with the injector being heated, for example. After the coil current sequences are determined and commanded the routine returns to step 813.

It is also possible to prepare injectors for heating after an engine shutdown. Specifically, in one example, the injector spool valve may be placed against a closing coil so that fuel flow is stopped and so that current may be applied to the closing coil of the injector without moving the spool valve from the open to the closed position. In this way, the spool valve may be pre-positioned before a time-varying current or before a substantially constant current is applied to a coil for heating purposes.

Figure 9:
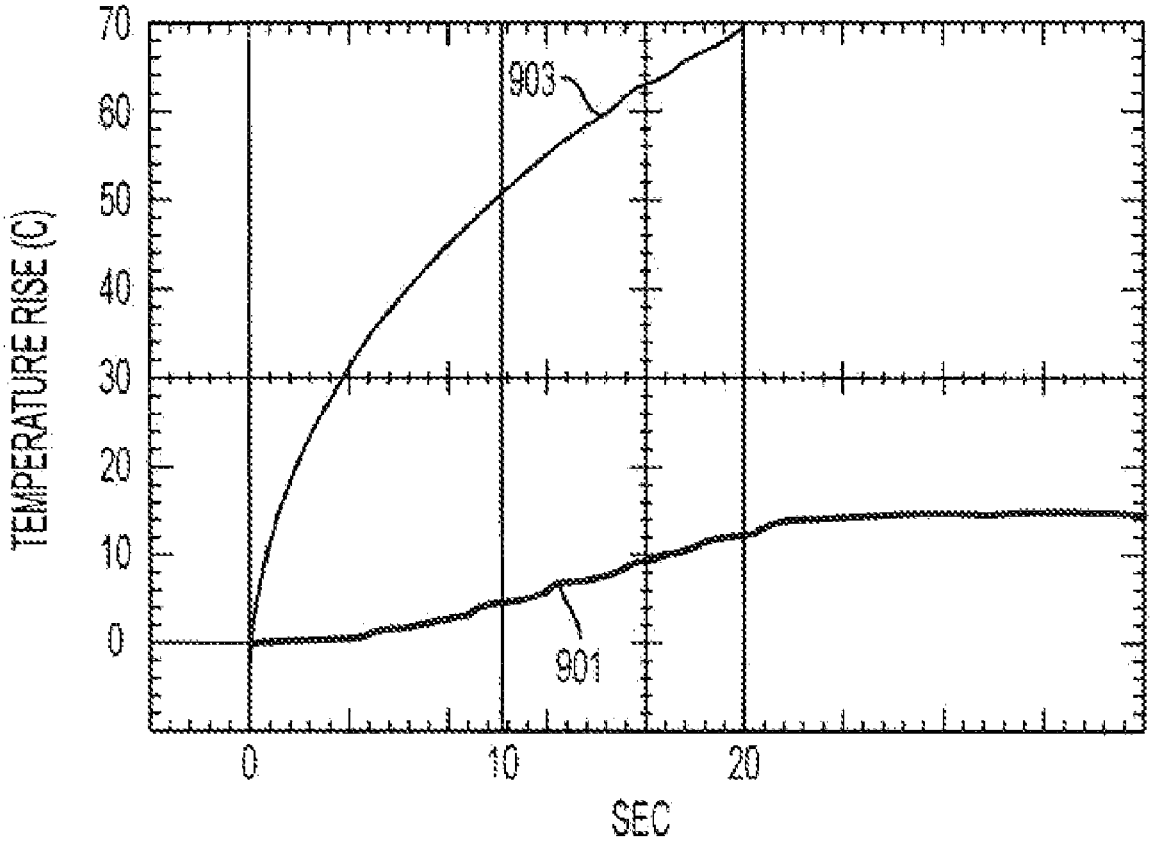
FIG. 9 is an example of temperature profiles produced by resistive and eddy current heating a fuel injector.

Referring now to FIG. 9, plots of resistive fuel injector heating and eddy current injector heating are shown. This plot represents the temperature rise in the spool valve and valve body area of a fuel injector when current is applied to an opening or closing coil for the purpose of heating a fuel injector. The y-axis represents the temperature rise in units of degrees Celsius. The x-axis represents the time since current is applied to the fuel injector coil. Curve 901 represents a temperature profile for a specified DC current that is applied to a coil. The temperature rise profile follows a first order response. The rate of temperature rise can be correlated to the amount of current flowing into the coil. The current flowing to the coil can be limited so that coil degradation is reduced. In one example, a model can be created that estimates the temperature rise of the coil based on the coil impedance and the amount of current entering the coil. When the coil temperature reaches a predetermined level the current flow to the coil can be stopped. The current can be periodically restarted to keep heat flowing to the fuel injector.

Curve 903 represents a temperature profile for a fuel injector when a time-varying current is applied to the fuel injector coil. This temperature profile also follows a first order response. However, the temperature increase is due to the eddy currents that are induced to the fuel injector materials as well as from the heat that is conducted from the coil. Thus, it is possible to create different fuel injector temperature profiles by adjusting the average value of the current entering the coil as well as the magnitude and frequency of the time-varying portion of the coil excitation.

As will be appreciated by one of ordinary skill in the art, the routines described in FIG. 8 may represent one or more of any number of processing strategies such as event-driven, interrupt-driven, multi-tasking, multi-threading, and the like. As such, various steps or functions illustrated may be performed in the sequence illustrated, in parallel, or in some cases omitted. Likewise, the order of processing is not necessarily required to achieve the objects, features and advantages described herein, but is provided for ease of illustration and description. Although not explicitly illustrated, one of ordinary skill in the art will recognize that one or more of the illustrated steps or functions may be repeatedly performed depending on the particular strategy being used.

This concludes the description. The reading of it by those skilled in the art would bring to mind many alterations and modifications without departing from the spirit and the scope of the description. For example, 2-stroke, 4-stroke, I3, I4, I5, V6, V8, V10, and V12 engines operating in natural gas, diesel, gasoline, gaseous fuels, or alternative fuel configurations could use the present description to advantage.

The invention claimed is:

1. A method for improving operation of an electrically controlled actuator, comprising:

applying a current to a coil of an electrically operable mechanical valve, said current applied at a frequency that is above a natural frequency of said mechanical valve and said current at a level sufficient to produce a power density at said coil to substantially raise a temperature of an armature of said electrically operable mechanical valve.

2. The method of claim 1 wherein said temperature of said armature is a surface temperature.

3. The method of claim 2 wherein said power density produces eddy currents that are sufficient to change a viscosity of a fluid in a boundary layer between said armature and a valve body.

4. The method of claim 1 wherein said electrically operable mechanical valve is a fuel injector and wherein an amplitude of said current is varied.

5. The method of claim 1 wherein said armature is a spool valve.

6. A method for improving operation of electrically operable mechanical valves, comprising:

applying a time-varying current to a coil of a plurality of electrically operable mechanical valves;

said time-varying current increasing eddy current in said plurality of electrically operable mechanical valves when a temperature decreases;

said time-varying current decreasing said eddy current in said plurality of electrically operable mechanical valves when said temperature increases; and said current being applied in an overlapping sequential one-after-the-other manner to said plurality of electrically operable mechanical valves.

7. The method of claim 6 wherein said temperature is a temperature of one of said plurality of electrically operable mechanical valves.

8. The method of claim 6 wherein said temperature is a temperature of an internal combustion engine.

9. The method of claim 6 wherein said plurality of electrically operable mechanical valves includes a fuel injector and wherein said coil is a closing coil of said fuel injector.

10. The method of claim 6 further comprising substantially maintaining an armature of each of said plurality of electrically operable mechanical valves in a position when said time-varying current is applied to said plurality of electrically operable mechanical valves.

11. The method of claim 6 wherein said time-varying current has an average value that is positive, negative, or zero.

12. The method of claim 6 wherein said time-varying current is supplied to said coil during a time wherein an engine is being prepared to start.

13. The method of claim 6 wherein a frequency, amplitude, or duty cycle of said time-varying current is varied with operating conditions of an internal combustion engine or with operating conditions of said plurality of electrically operable mechanical valves.

14. The method of claim 6 wherein said time-varying current is bi-polar.

15. The method of claim 6 wherein said time-varying current is uni-polar.

16. A system to improve performance of an electrically operable mechanical valve actuator, comprising:

an internal combustion engine;

an electrically operable mechanical valve actuator operable as a component of said internal combustion engine; and a controller to supply a time-varying current to at least a coil of said electrically operable mechanical valve actuator, said controller adjusting said time-varying current to increase hysteresis losses in said electrically operable mechanical valve actuator as a temperature decreases, and said controller adjusting said time-varying current to decrease hysteresis losses in said electrically operable mechanical valve actuator as said temperature increases, said controller adjusting a timing of said electrically operable mechanical valve actuator as an amount of heating energy supplied to the electrically operable mechanical valve actuator varies.

17. The system of claim 16 wherein a frequency, amplitude, and/or a duty cycle of said time-varying current varies with operating conditions of said internal combustion engine or with said electrically operable mechanical valve actuator.

18. The system of claim 16 further comprising discontinuing said time-varying current after a predetermined period of time.

19. The system of claim 16 wherein said coil is a closing coil of said electrically operable mechanical valve actuator.

20. The system of claim 16 wherein the coil is an actuator coil of said electrically actuated valve actuator and further comprises operating said internal combustion engine and adjusting said time-varying current during operation of said internal combustion engine to heat a fuel injector.

* * * * *